United States Patent [19]

Andrews et al.

[11] 3,947,613

[45] Mar. 30, 1976

[54] PROCESS FOR REDUCING AGENT MIGRATION DURING TREATMENT OF KNITTED COTTON FABRIC

[75] Inventors: Bethlehem K. Andrews; John G. Frick, Jr., both of New Orleans; Wilson A. Reeves, Metairie, all of La.

[73] Assignee: The United States of America as represented by the Secretary of Agriculture, Washington, D.C.

[22] Filed: Aug. 7, 1974

[21] Appl. No.: 495,461

[52] U.S. Cl. ..... 427/242; 427/390; 427/381; 427/421; 427/429; 427/439

[51] Int. Cl.[2] ..... B05D 3/12; B05D 3/02

[58] Field of Search ..... 117/143 A, 104 R, 109, 117/65.2; 427/242, 390, 421, 439, 346, 429, 381

[56] References Cited

UNITED STATES PATENTS

| | | | |
|---|---|---|---|
| 3,333,983 | 8/1967 | Sellet | 117/143 A |
| 3,445,277 | 5/1969 | Smith | 117/104 R |
| 3,546,006 | 12/1970 | Verburg et al. | 117/143 A |
| 3,674,418 | 7/1972 | Lyons et al. | 117/104 R |

*Primary Examiner*—Cameron K. Weiffenbach
*Assistant Examiner*—R. Eugene Varndell, Jr.
*Attorney, Agent, or Firm*—M. Howard Silverstein; Salvador J. Cangemi; Max D. Hensley

[57] ABSTRACT

Knitted cotton fabrics in tubular form are impregnated to 20 to 35% wet add-on of crosslinking agent by any of several techniques including sprinkling, spraying, printing, or slop padding the solution of crosslinking agent to the outer surfaces of the fabric tube, or transferring the solution of crosslinking agent from impregnated material to the outer surfaces of the fabric tube, followed by a mechanical agitation step wherein the impregnated tubes are mechanically agitated at elevated temperatures under closed conditions, thereby eliminating agent migration toward fabric surfaces during drying of the cotton containing knitted fabrics in chemical treatments for smooth-drying properties and dimensional stabilization.

5 Claims, No Drawings

PROCESS FOR REDUCING AGENT MIGRATION DURING TREATMENT OF KNITTED COTTON FABRIC

This invention relates to chemical treatments of cotton and other cellulosic knitted fabric in tubular form. More particularly, this invention relates to a process for chemical finishing of cellulose-containing knitted fabrics to effect uniform crosslinking throughout the fabric. Specifically this invention relates to a new method of impregnation of the crosslinking chemicals prior to drying and curing of the impregnated textile, the novelty comprising two steps, application of the crosslinking agent to the tubular textile to achieve a wet add-on of 20 to 35% such that about 2 to 9% solids as crosslinking agent is applied to the fabric, and mechanical agitation of the textile in this moist state at elevated temperatures in a closed system to afford uniform and complete penetration of the crosslinking agent throughout the fibers in the fabric. Hereinafter this novel method of textile finishing is referred to as uniformly distributed low wet add-on.

Field to Which This Invention Relates

To all of the presently employed processes for producing knitted fabrics with improved smooth-drying properties and good dimensional stability, the common step is impregnation (via padding) of the knitted fabric with a solution of crosslinking agent and catalyst to a wet add-on of from about 70 to 100%. The most common finishing operation uses the pad-dry-cure process. In this process, after the padding step, the fabrics are first dried at slightly elevated temperatures (60° to 100°C) and then cured at high (150° to 165°C) temperatures. In a variation of this process garments are fabricated from the dried (sensitized) fabric, desired creases are pressed into the garment, and the completed garment is cured at high temperatures. This is a sensitize-crease-cure, or post-cure, technique.

In another process, after impregnation as mentioned above, the fabrics are dried and cured in one step (shock- or flash- curing).

The Problem

In both of these processes, as the water is dried from the fabric, the crosslinking agent migrates from the interior of the fabric to the outer surfaces, and, in the case of fabrics processed in tubular form, from the inner surfaces to the outer surfaces of the fabric tubes as well, causing non-uniform crosslinking throughout the fabric, compounding the problem. Because many knitted fabrics are finished in the tubular form in which they come off a circular knitting machine, and are slit, if at all, for stripe matching after the curing step, there is ample opportunity for migration to occur. In these multiple-layered fabrics a heat gradient probably exists between the surfaces and also between the layers during drying. This migration is a factor in producing poor hand of fabric. It also causes migration of non-substantive direct dyes during after-finishing for smooth-drying properties. This migration also causes non-uniform pick-up of optical brighteners from laundry detergents during washing of the chemically finished fabrics.

If a maximum and excess amount of water is introduced into the fabric during the impregnation step, migration will occur during drying, and methods to produce uniform treatments must, in some manner, reverse the migration of crosslinking agent from the surfaces back to the interior of the fabric. If only the amount of water necessary for carrying the crosslinking agent uniformly throughout the capillaries of the fabric were introduced into the fabric on application of crosslinking agent, the opportunity for migration to occur at all during drying could be eliminated. Therefore, the problem is to apply the crosslinking agent so that it is distributed uniformly throughout the fabric without the use of an amount of water that is so large as to cause the migration on drying that disturbs the uniform distribution.

The Prior Art

Methods reported to eliminate this agent migration have employed techniques which either retard the drying step or introduce a two stage drying step broken by a time lapse greater than five hours between stages after impregnation to a wet add-on of from 80 to 100% (see "Migration and Diffusion of Finishing Agents in Drying" Textile Research Journal 38, pp. 176–182 (1968). These techniques allow sufficient time for back diffusion of the agent to occur, reversing migration and thus minimizing the nonuniformity of distribution. These techniques, although successful in improving uniformity, require an extension of finishing time to a point not economically feasible for the American textile industry.

Object of the Invention

The chief objective of the instant invention is to create a process for imparting to tubular fabrics smooth-drying properties and dimensional stability that uniformly distributes the crosslinking agent throughout the entire fabric without the need for inclusion of a time delay of several hours to redistribute the crosslinking agent throughout the fabric and that reduces the amount of unnecessary water present in the fabric at the time of impregnation, thus lessening the drying time.

How the Objective is Achieved

We have found that the crosslinking agent can be uniformly distributed throughout a knitted fabric in tubular form by a combination of reducing the wet add-on of the crosslinking formulation of the textile to a minimum amount necessary to carry the crosslinking agent throughout the fibers and mechanically agitating the moist textile at slightly elevated temperatures for a short period of time to promote complete penetration of crosslinking agent throughout the capillaries of the fabric. The crosslinking formulation includes, in addition to the crosslinking agent, a catalyst, and a surfactant.

Crosslinking agents suitable for use in this invention are the methylol amide group of agents such as dimethylol ethyleneurea or dimethylol dihydroxyethyleneurea. The specific crosslinking agent selected, however, is not integral to the process of the invention and any crosslinking agent which imparts durable-press properties and dimensional stability to cellulose-containing knitted textiles is suitable for use in the instant invention.

Catalysts suitable for use in this invention are of the latent-acid types and include magnesium chloride hexahydrate and zinc nitrate hexahydrate. Any catalyst that promotes the reaction between crosslinking agent and cellulose, however, is suitable for use in the instant invention.

Surfactants for use in this invention are those that promote diffusion of the crosslinking solution throughout the capillaries of the cellulose-containing knitted fabric and include the class containing octyl phenols etherified with poly (oxyethylene) glycol.

Although there may be many variables to the instant invention which would be covered by the process of the instant invention, the instant invention can be described as a process for imparting smooth-drying, or durable-press, properties and dimensional stabilization to cellulose-containing fibrous material, the process comprising:

a. applying to the tubular knitted cotton textile by sprinkling, spraying, printing, slop padding, by transfer from impregnated material, or by any other conventional manner, to a wet add-on of from 20 to 35%, an aqueous solution containing from 12 to 25% of a crosslinking agent, an acid-type catalyst, and a non-ionic surfactant, followed by passage of the moist textile through squeeze rolls, and b. mechanically agitating the impregnated textile under closed conditions to prevent water evaporation at temperatures ranging from 45° to 75°C for times ranging from 10 to 15 minutes, and c. further processing the textile of uniformly distributed low wet add-on by the common dry-cure, or sensitize-crease-cure techniques, with drying times reduced if desired, because of the lessened amount of water present in the fabric.

The Impregnation Step

A wet add-on of 20 to 35% crosslinking formulation is achieved by several techniques. Two of the techniques that are effective are:

a. spraying the surfaces of the knitted fabric tube to the above mentioned wet add-ons by the use of a spraying device containing the crosslinking formulation under air pressure so that a fine, uniform mist contacts the fabric surfaces, followed by passage of the moist fabric through squeeze rolls, and b. impregnating, by a dip and nip process, two sheets of absorbent material, such as knitted or woven fabric, or polyurethane foam sheeting, to a wet add-on of 80 to 100% then placing the knitted tube between these two impregnated layers and passing the resultant four-layered assembly between two squeeze rolls to transfer to the knitted tube a wet add-on of 20 to 35%.

In both of these techniques it is desirable to include in the crosslinking formulation a surfactant that decreases the surface tension of the solution, fosters positive adsorption of the solution at the interface between capillaries of the fiber and aids penetration of the crosslinking agent throughout the entire fabric.

The Mechanical Agitation (Milling) Step

The mechanical agitation step consists of sealing the moist fabric from the atmosphere for from 10 to 15 mintues in a rotating drum so that the temperature inside the drum is from 45° to 75°C. In the instant invention for the purposes of laboratory demonstration, the moist fabrics were sealed in heat resistant plastic bags before placing inside a rotating drum to which hot air was supplied and exhausted to maintain the above mentioned temperature. On a larger scale, however, in commercial applications of this method, sealing the fabrics in plastic bags is not a necessary or integral part of the packaging procedure during milling.

Summary of the Invention

In summary, this invention provides a process for imparting a uniform finish to knitted materials containing a cellulosic component to produce a product with improved smooth-drying, or durable press properties and dimensional stability. The advantages of smooth-drying and dimensional stability are well known and are a necessity for garments that are acceptable to the American consumer. The uniformity of treatment achieved by this process is a necessity in eliminating bloom, streaks, and off-shades of dyes in fabrics treated for durable press and in eliminating uneven pickup of additives from laundering during garment use.

The following examples are provided to illustrate the practice and results of the process of the instant invention and are not in any way intended to limit the scope of the invention. All percentages shown in the examples are percentages by weight of the total solution. Current test methods of the American Association of Textile Chemists and Colorists (AATCC) and American Society for Testing Materials (ASTM) were used in evaluating the textile properties of the fabrics. The resistance of crosslinked cotton to dyeing in the ASTM D 1464–63 test, Differential Dyeing Behavior of Cotton, was used as a criterion for uniformity of treatment and extent of agent migration. In this modified test, the green dye was omitted from the procedure. The shade differences in dye resistance between surfaces of the same layer of the fabric tube were rated using the Gray Scale, with T indicating the layer facing upward and B indicating the layer facing downward during horizontal processing. The fact (*f*) is the technical face of the fabric and was to the outside of the fabric tube during processing; the back (*b*) is the technical back of the fabric and was to the inside of the fabric tube during processing. The Gray Scale Ratings also are an indication of the evenness of pick-up of optical brightener between fabric surfaces during subsequent laundering of the crosslinked fabrics, a fact known to those skilled in the art. Nitrogen contents were determined by the Kjeldahl method.

EXAMPLE 1

The outer surface of each layer of samples of a 3.07 sq.yd/lb. cotton jersey fabric of 20/1 yarn knitted in a cross-tuck pattern, and in tubular form, was sprayed to the indicated wet add-ons with an aqueous solution containing 20% dimethylol dihydroxyethyleneurea (DMDHEU), 6.0% magnesium chloride hexahydrate, 0.1% 29-(isooctylphenoxy)-3,6,9,12,15,18,21,24,27-nonaoxanonacosan-1-ol. This step was followed by passing the sprayed tubular knit through squeeze rolls. The impregnated fabric was then sealed in heat resistant plastic bags and mechanically agitated (milled) for 15 minutes in a rotating drum to which air was supplied and exhausted at elevated or ambient temperatures in order to maintain the temperature inside the drum at the values indicated in Table I. After the milling step the samples were dried at 70°C for 10 minutes and cured at 160°C for 3 minutes. The cured samples were washed and tumbled dry before testing. A tubular sample not mechanically agitated and a tubular sample padded from an aqueous solution containing 6% dimethylol dihydroxyethyleneurea, 1.8% magnesium chloride hexahydrate and 0.1% 29-(isooctylphenoxy)-3,6,9,12,15,18,21,24,27-nonaoxanonacosan-1-ol to a wet add-on of 90–100% were dried and cured as above to give samples for comparison. The wet add-on, milling conditions, percent nitrogen and differences in face to back receptivity to a direct dye as shown by the Gray Scale Rating for each layer of the tube are shown in Table I.

TABLE I

| Wet Add-On (%) | Milling Conditions Time (min) | Milling Conditions Temp (°C) | Nitrogen Content (%) T | Nitrogen Content (%) B | f/b Gray Scale Rating T | f/b Gray Scale Rating B |
|---|---|---|---|---|---|---|
| Spray-mill | | | | | | |
| 26 | 0 | — | — | — | 2 | 2 |
| 28 | 15 | 25 | 1.0 | 1.2 | 3 | 3 |
| 27 | 15 | 45–57 | 1.3 | 1.2 | 4 | 4 |
| 27 | 15 | 57–69 | 1.1 | 0.9 | 4 | 4 |
| 28 | 15 | 65–75 | 1.4 | 1.2 | 5 | 5 |
| Conventional pad-dry-cure | | | | | | |
| 90–100 | 0 | — | — | — | 4 | 1 |

The data indicate that completely uniform treatment throughout the fabric is attained in the sample sprayed to give a low wet add-on combined with milling at 65° to 75°C for 15 minutes. A conventional pad-dry-cure procedure did not produce a uniform treatment. Milling the samples with low add-on at temperatures of 45° to 65°C increased the uniformity of treatment but did not completely eliminate agent migration. Other tubular samples padded in the conventional manner with solutions containing 6% dimethylol dihydroxyethyleneurea and milled for 15 minutes at 25°C and 65° to 75°C before drying and curing conventionally had face/back Gray Scale Ratings of 2 for each layer of the tube after dyeing, indicating that the combination of low wet add-on and milling is necessary for eliminating agent migration.

EXAMPLE 2

The outer surface of each layer of tubular samples of patterned cotton jersey mentioned in Example 1 was sprayed to the wet add-ons listed in Table II with aqueous solutions containing 12,16 and 20% dimethylol dihydroxyethyleneurea (DMDHEU), magnesium chloride hexahydrate as 30% of agent weight and 0.1% 29-(isooctylphenoxy)-3,6,9,12,15,18,21,24,27-nonaoxanonacosan-1-ol. This step was followed by passing the sprayed tubular knit through squeeze rolls. The impregnated fabric was then sealed in heat resistant plastic bags and milled for 15 minutes at 65° to 75°C, dried, cured and washed as described in Example 1. Wet add-ons, nitrogen content and comparison of face/back receptivity to a direct dye by Gray Scale Ratings for each layer of the tube are shown in Table II.

TABLE II

| DMDHEU In Spray (%) | Wet Add-On (%) | Nitrogen Content (%) T | Nitrogen Content (%) B | f/b Gray Scale Rating T | f/b Gray Scale Rating B |
|---|---|---|---|---|---|
| 20 | 28 | 1.4 | 1.2 | 5 | 5 |
| 16 | 29 | 0.9 | 0.9 | 4 | 4 |
| 12 | 50 | 1.1 | 1.2 | 4 | 4 |

Spraying to 29% wet add-on from a solution containing 16% dimethylol dihydroxyethyleneurea increases the uniformity of agent throughout the fabric, but does not produce complete uniformity. Spraying to 50% wet add-on from a solution containing 12% dimethylol dihydroxyethyleneurea also increases, but does not produce complete uniformity of agent throughout the fabric. The sample sprayed from a 20% dimethylol dihydroxyethyleneurea solution and milled at 65° to 75°C for 15 minutes does produce a fabric with a completely uniform treatment.

EXAMPLE 3

The outer surface of each layer of tubular samples of patterned cotton jersey mentioned in Example 1 was sprayed to the indicated wet add-ons with aqueous solutions containing 20% dimethylol dihydroxyethyleneurea, 6% magnesium chloride hexahydrate and 0.1% 29-(isooctylphenoxy)-1,3,6,9,12,15,18,21,24,27-nonaoxanonacosan-1-ol. This step was followed by passing the sprayed tubular knit through squeeze rolls. The impregnated fabric was then sealed in heat resistant plastic bags and milled for 5, 10, and 15 minutes at 65° to 75°C as described in Example 1. Drying, curing and washing of the cured samples were performed as described in Example 1. Wet add-ons, nitrogen content and comparison of face/back receptivity to a direct dye as shown by Gray Scale Ratings for each layer of the tube are shown in Table III.

TABLE III

| Wet Add-On (%) | Milling Time (Min.) | Nitrogen Content (%) T | Nitrogen Content (%) B | f/b Gray Scale Rating T | f/b Gray Scale Rating B |
|---|---|---|---|---|---|
| 28 | 15 | 1.4 | 1.2 | 5 | 5 |
| 30 | 10 | 1.5 | 1.0 | 5 | 5 |
| 28 | 5 | 1.5 | 1.0 | 4 | 4 |

Spraying to 28 to 30% wet add-ons, followed by milling at 65° to 75°C for from 10 to 15 minutes produces fabrics with a completely uniform treatment throughout each fabric layer.

EXAMPLE 4

The outer surface of each layer of tubular samples of patterned cotton jersey mentioned in Example 1 and of the same patterned cotton jersey which had been premercerized were sprayed to the indicated wet add-ons with aqueous solutions containing 20% dimethylol dihydroxyethyleneurea, 6% magnesium chloride hexahydrate and 0.1% 29-(isooctylphenoxy)-3,6,9,12,15,18,21,24,27-nonaoxanonacosan-1-ol, passed through squeeze rolls and milled for 15 minutes at 65° to 75°C as described in Example 1. Drying, curing, and washing of the cured samples were performed as described in Example 1. Wet add-ons, nitrogen content and comparison of face/back receptivity to a direct dye as shown by Gray Scale Ratings for each layer of the tube are shown in Table IV.

TABLE IV

| Fabric | Wet Add-On (%) | Nitrogen Content (%) T | Nitrogen Content (%) B | f/b Gray Scale Ratings T | f/b Gray Scale Ratings B |
|---|---|---|---|---|---|
| Unmercerized[1/] | 28 | 1.4 | 1.2 | 5 | 5 |
| Mercerized[2/] | 31 | 1.6 | 1.6 | 5 | 5 |

[1/]Sample unmercerized before crosslinking
[2/]Sample mercerized at original dimensions for 3 minutes with 20% NaOH, soured with 5% acetic acid, rinsed in water and dried before crosslinking.

Reduction of wet add-on to under 32% combined with milling at 65° to 75°C is effective in producing a completely uniform treatment in mercerized as well as unmercerized fabric.

EXAMPLE 5

Tubular samples of the patterned cotton jersey mentioned in Example 1 were padded in the conventional manner to 90 to 100% wet add-on with a solution containing 6% dimethylol dihydroxyethyleneurea and 1.8% magnesium chloride hexahydrate. The padded samples were dried on horizontal pin frames at 70°C for 4 minutes and 40 seconds to the indicated wet add-ons. The partially dried samples were then removed from the frames and milled in heat resistant plastic bags as described in Example 1 at 25°C or 65° to 75°C for 15 or 30 minutes before remounting on horizontal pin frames to complete the drying at 70°C for 5 minutes and 20 seconds. The samples were cured for 5 minutes at 160°C and washed as described in Example 1. The effectiveness of milling tubular fabric in a two stage drying process, as indicated by face/back receptivity to a direct dye as shown by Gray Scale Ratings for each layer of the tube is shown in Table V.

TABLE V

| Wet Add-On After 1st Dry Step (%) | Milling Conditions Time (Min) | Milling Conditions Temp. (°C) | f/b Gray Scale Rating T | f/b Gray Scale Rating B |
|---|---|---|---|---|
| 33 | 30 | 25 | 3 | 3 |
| 31 | 15 | 25 | 3 | 3 |
| 33 | 30 | 67–75 | 2 | 3 |
| 34 | 15 | 67–75 | 2 | 3 |

In none of these samples does the mechanical or heat energy promote back migration during the milling step to compensate for the migration that occurs during the first stage of drying to produce a non-uniformity of agent distribution. All of the Gray Scale Ratings are 3 or below. A sample that was also padded conventionally to 90 to 100% wet add-on, mounted on pin frames, sealed in a plastic bag and batched at 25°C for 30 minutes with no mechanical agitation before drying and curing conventionally, and a sample padded conventionally to 90 to 100% wet add-on, partially dried to 30% wet add-on, sealed in a heat resistant plastic bag at 70°C for 15 minutes with no mechanical agitation before completion of drying and curing conventionally, both also have face/back Gray Scale Ratings of 3 or under. For shortened time processing, reduced add-on *before the drying step* as well as milling is necessary for uniformity of treatment.

EXAMPLE 6

Single layers of the cotton patterned jersey described in Example 1 and measuring 15 in. × 16 in. were padded to 90 to 100% wet add-on with an aqueous solution containing 16 or 20% dimethylol dihydroxyethyleneurea (DMDHEU), magnesium chloride hexahydrate as 30% of agent weight, and 0.1% 29-(isooctylphenoxy)-3,6,9,12,15,18,21,24,27-nonaoxanonacosan-1-ol. Tubular samples of the same jersey, measuring 12 in. × 13 in. were placed between these padded single layers of knitted fabric (transfer medium) and the resultant multiple layered assembly was passed between squeeze rolls to transfer the crosslinking agent to the outer surfaces of the tubular samples. The tubular samples, of wet add-on listed in Table VI were, either mechanically agitated (milled) at 65° to 75°C for 5, 10, or 15 minutes as described in Example 1 before drying, curing, and washing as described in Example 1, or dried, cured and washed with the milling step omitted. Nitrogen content and the Gray Scale Ratings for each layer of the tubular samples are shown in Table VI.

TABLE VI

| DMDHEU Concentration Padded to Transfer Medium (%) | Wet Add-On (%) | Milling Time (Min) | Nitrogen Content (%) T | Nitrogen Content (%) B | f/b Gray Scale Rating T | f/b Gray Scale Rating B |
|---|---|---|---|---|---|---|
| 20 | 31 | 0 | 0.9 | 1.0 | 2 | 2 |
| 20 | 31 | 5 | 0.9 | 0.8 | 3 | 3 |
| 20 | 31 | 15 | 0.8 | 0.8 | 5 | 5 |
| 16 | 29 | 10 | 0.6 | 0.6 | 4 | 4 |
| 16 | 27 | 15 | 0.6 | 0.6 | 5 | 5 |

The Gray Scale Ratings show that a uniform treatment of the knitted fabric tubes can be obtained by a reduction of wet add-on to 31% or less via transfer from layers impregnated from 16 to 20% solutions.

EXAMPLE 7

The crosslinking agent and catalyst used to produce a uniformly distributed low wet add-on are by no means limited to dimethylol dihydroxyethyleneurea (DMDHEU) and magnesium chloride hexahydrate. Single layers of the cotton patterned jersey described in Example 1 were padded as described in Example 6 with aqueous solutions containing 20% dimethylol dihydroxyethyleneurea (DMDHEU), zinc nitrate hexahydrate as 10% of agent weight and 0.1% 29-(isooctylphenoxy)-3,6,9,12,15,18,21,24,27-nonaoxanonacosan-1-ol; 20% dimethylol ethyleneurea (DMEU), zinc nitrate hexahydrate as 10% of agent weight and 0.1% 29-(isooctylphenoxy)-3,6,9,12,15,18,21,24,27-nonaoxanonacosan-1-ol, or 20% dimethylol ethyleneurea (DMEU) magnesium chloride hexahydrate as 30% of agent weight, and 0.1% 29-(isooctylphenoxy)-3,6,9,12,15,18,24,27-nonaoxanonacosan-1-ol. The crosslinking agent solution was then transferred from the impregnated transfer mediums to tubular samples of the same jersey, the moist tubular samples milled for 15 minutes at 65° to 75°C, dried, cured and washed as described in Example 6. Durable press ratings, nitrogen content, shrinkage in the wales direction after one home laundry cycle, and face/back receptivity to a direct dye as shown by Gray Scale Ratings for each layer of the tubular samples are shown in Table VII.

TABLE VII

| Crosslinking Agent and Catalyst | Wet Add-on (%) | Nitrogen Content (%) T | Nitrogen Content (%) B | Durable Press Rating T | Durable Press Rating B | Wales shrinkage (%) T | f/b Gray Scale Rating T | f/b Gray Scale Rating B |
|---|---|---|---|---|---|---|---|---|
| DMDHEU-$Zn(NO_3)_2.6H_2O$ | 22 | 0.5 | 0.6 | 4.0 | 3.9 | 4.8 | 5 | 5 |

TABLE VII-continued

| Crosslinking Agent and Catalyst | Wet Add-on (%) | Nitrogen Content (%) T | Nitrogen Content (%) B | Durable Press Rating T | Durable Press Rating B | Wales shrinkage (%) T | f/b Gray Scale Rating T | f/b Gray Scale Rating B |
|---|---|---|---|---|---|---|---|---|
| DMEU-$Zn(NO_3)_2.6H_2O$ | 23 | 0.9 | 0.8 | 4.3 | 4.0 | 4.6 | 5 | 5 |
| DMEU-$MgCl_2.6H_2O$ | 22 | 1.0 | 0.9 | 4.3 | 4.1 | 4.6 | 5 | 5 |

The fabrics have good durable press properties and dimensional stability acceptable for outerwear end uses. The Gray Scale Ratings show that a uniform treatment is obtained by a reduction of wet add-on to 23% or less via transfer from layers of cotton jersey impregnated from 20% solutions of methylol amide crosslinking agents containing latent acid catalysts, combined with a mechanical agitation step of 10 to 15 minutes at 65° to 75°C.

EXAMPLE 8

The transfer medium is by no means limited to cotton fabrics. Single layers of 1/2 in. thick polyurethane foam sheeting were padded to 90 to 100% wet add-on with solutions containing 20% dimethylol dihydroxyethyleneurea, 6% magnesium chloride hexahydrate and 0.1% 29-(isooctylphenoxy)-3,6,9,12,15,18,21,24,27-nonaoxanonacosan-1-ol as described in Example 6. The crosslinking agent solution was then transferred from these layers of polyurethane foam to the patterned cotton jersey mentioned, and as described in, Example 6. One of the tubular samples so processed was dried and cured conventionally with no milling step. The other sample was milled for 15 minutes at 65° to 75°C, as described in Example 1, before conventionally drying, curing and washing. Nitrogen contents and receptivity to a direct dye as shown by face/back Gray Scale Ratings for each layer of the tubular fabric are shown in Table VIII.

TABLE VIII

| Wet Add-on (%) | Milling Conditions Time (min) | Milling Conditions Temp (°C) | Nitrogen Content (%) T | Nitrogen Content (%) B | f/b Gray Scale Rating T | f/b Gray Scale Rating B |
|---|---|---|---|---|---|---|
| 22 | 0 | — | 2.1 | 0.7 | 1 | 1 |
| 35 | 15 | 65–75 | 1.7 | 1.7 | 5 | 5 |

A uniform treatment can be obtained if polyurethane foam sheeting is used as the transfer medium in the process described in Example 6.

EXAMPLE 9

Tubular samples of the patterned cotton jersey mentioned in Example 1 were given crosslinking treatments that were uniform throughout the fabric according to the spray-mill process described in Example 6. In both of these processes the crosslinking solution contained 20% dimethylol dihydroxyethyleneurea, 6% magnesium chloride hexahydrate and 0.1% 29-(isooctylphenoxy)-3,6,9,12,15,18,21,24,27-nonaoxanonacosan-1-ol. The textile properties of the fabrics from these two processes, with those of an untreated fabric are shown in Table IX.

TABLE IX

| Treatment | Bursting Strength (psi) T | Bursting Strength (psi) B | Resistance to Flat Abrasion (Stoll Test) (cycles) T | Resistance to Flat Abrasion (Stoll Test) (cycles) B | Durable Press Rating T | Durable Press Rating B |
|---|---|---|---|---|---|---|
| Untreated fabric | 93 | | 184 | | 2.5 | |
| Spray-mill | 39 | 34 | 151 | 123 | 3.9 | 3.7 |
| Transfer-mill | — | — | 134 | 158 | 3.8 | 3.6 |

The fabrics have good durable press properties, and strength and resistance to flat abrasion similar to those in samples processed conventionally. That knitted cotton fabrics processed to the durable press levels shown in this example have dimensional stability acceptable for outerwear end uses is known to those skilled in the art.

EXAMPLE 10

Single layered samples of the patterned cotton jersey described in Example 1 were padded with 20% dimethylol dihydroxyethyleneurea, 6% magnesium chloride hexahydrate and 0.1% 29-(isooctylphenoxy)-3,6,9,12,15,18,21,24,27-nonaoxanonacosan-1-ol to 25 to 30% wet add-on by the transfer technique described in Example 6. One sample was mechanically agitated in a heat-resistant plastic bag at 65° to 75°C for 15 minutes before oven drying and curing, and the other sample was dried and cured without a milling step. After dyeing with a direct dye, the samples were examined for uneven distribution of agent by comparing Gray Scale Ratings, both face/back, and surface/interior, on examination of fabric cross-sections. The results from these treatments are presented in Table X.

TABLE X

| Technique | Shade difference face/back | Gray Scale Rating surface/interior |
|---|---|---|
| Milled | 5 | 5 |
| Not milled | 5 | 1 |

A combination of lowered wet add-on and mechanical agitation is necessary for producing uniform distribution, even in single layers of fabrics.

We claim:

1. A process for imparting to tubular knitted cotton textiles the enhancing qualities of durable press and dimensional stability by means of a chemical finish that is uniform throughout the fibers of the fabric and results in generally superior properties of the textile and in elimination of shade and color differences between fabric surfaces on subsequent dyeing, the process comprising:

a. impregnating the tubular knitted cotton to a wet pick-up of from 20 to 35% with an aqueous solution containing:
   1. a methylol amide crosslinking agent,
   2. an acid catalyst, and
   3. a non-ionic surfactant, and
b. mechanically agitating the impregnated textile for from 10 to 15 minutes at temperatures of from 45° C. to 75° C. while preventing water evaporation from said textile;
c. drying the mechanically agitated moist textile; and
d. curing the dry textile at an elevated temperature.

2. The process of claim 1 wherein the impregnation is effected by spraying the surface of the textile.

3. The process of claim 1 wherein the methylol amide crosslinking agent is selected from the group consisting of dimethylol ethyleneurea and dimethylol dihydroxyethyleneurea, the acid catalyst is selected from the group consisting of magnesium chloride hexahydrate and zinc nitrate hexahydrate, and the surfactant is produced by the etherification of octyl phenol with poly(oxyethylene) glycol.

4. The process of claim 1 wherein the impregnation is effected by transferring the aqueous solution from a knitted cotton fabric padded in said solution to a wet pick-up of 80–100% by passing through squeeze rolls.

5. The process of claim 1 wherein the impregnation is effected by transferring the aqueous solution from polyurethane foam sheeting padded in said solution to a wet pick-up of 80 to 100% by passing through squeeze rolls.

* * * * *